US010221723B2

(12) United States Patent
Dagorn et al.

(10) Patent No.: US 10,221,723 B2
(45) Date of Patent: Mar. 5, 2019

(54) HEAT SHIELD FOR A LOW-PRESSURE TURBINE STEAM INLET DUCT

(71) Applicant: ALSTOM Technology Ltd, Baden (CH)

(72) Inventors: Kevin Dagorn, Puteaux (FR); Xavier Laurent, Villepinte (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 820 days.

(21) Appl. No.: 13/908,149

(22) Filed: Jun. 3, 2013

(65) Prior Publication Data

US 2013/0323036 A1 Dec. 5, 2013

(30) Foreign Application Priority Data

Jun. 4, 2012 (FR) ..... 12 55193

(51) Int. Cl.
*F01D 25/26* (2006.01)
*F01D 9/06* (2006.01)
*F01D 25/14* (2006.01)

(52) U.S. Cl.
CPC ..... *F01D 25/26* (2013.01); *F01D 9/065* (2013.01); *F01D 25/145* (2013.01); *F05D 2220/31* (2013.01)

(58) Field of Classification Search
CPC ..... F01D 25/145; F01D 25/243; F01D 25/26; F01D 9/02; F01D 9/065; F01D 9/06; F05D 2220/31
USPC ..... 415/139, 177, 178
See application file for complete search history.

(56) References Cited

U.S. PATENT DOCUMENTS 2,510,606 A * 6/1950 Price ..... F01D 5/085 415/139
3,742,670 A * 7/1973 Byrd, Jr. ..... F02K 1/80 110/336
5,127,794 A * 7/1992 Burge ..... F01D 11/18 415/173.3
5,127,797 A * 7/1992 Carman ..... F01D 25/246 415/209.2

(Continued)

FOREIGN PATENT DOCUMENTS

CN 1294250 A 5/2001
CN 101218416 A 7/2008

(Continued)

OTHER PUBLICATIONS

Kuzneysov, "Big Explanatory Dictionary of Russian language", Norint, pp. 1169, 2000.

(Continued)

*Primary Examiner* — Kenneth Bomberg
*Assistant Examiner* — Jesse Prager
(74) *Attorney, Agent, or Firm* — Cynthia W. Flanigan; Global Patent Operation

(57) ABSTRACT

The present invention relates to an assembly comprising a duct, preferably a turbine duct, and at least one segment formed of at least two rigid shells, each shell comprising at least one fixing orifice for fixing to the duct and at least one fixing element at least one boss per shell which boss is fixed to the duct and against which boss the shell rests, such that at least one orifice and one boss face one another, and that the fixing element passes through the orifice facing the boss and is fixed to the boss.

13 Claims, 4 Drawing Sheets

(56) References Cited

U.S. PATENT DOCUMENTS

| | | | | |
|---|---|---|---|---|
| 6,041,590 | A * | 3/2000 | Hayton | F02K 1/822 60/766 |
| 7,074,009 | B2 * | 7/2006 | Allmang | F01D 9/026 415/177 |
| 7,101,147 | B2 * | 9/2006 | Balsdon | F01D 11/005 277/642 |
| 8,033,722 | B2 | 10/2011 | Kulkarni et al. | |
| 8,916,011 | B2 * | 12/2014 | Holland | B64D 29/00 156/227 |
| 2005/0089401 | A1 * | 4/2005 | Phipps | F01D 11/16 415/178 |
| 2005/0150632 | A1 * | 7/2005 | Mayer | F01D 25/08 165/47 |
| 2010/0316491 | A1 | 12/2010 | Yamashita et al. | |
| 2012/0047905 | A1 | 3/2012 | Rauch et al. | |

FOREIGN PATENT DOCUMENTS

| | | |
|---|---|---|
| CN | 101341318 A | 1/2009 |
| CN | 102112854 A | 6/2011 |
| GB | 1 118 257 | 6/1968 |
| GB | 1 396 134 | 6/1975 |

OTHER PUBLICATIONS

Office Action issued in connection with corresponding RU Application No. 2013125566 dated Oct. 1, 2014.

* cited by examiner

HEAT SHIELD FOR A LOW-PRESSURE TURBINE STEAM INLET DUCT

TECHNICAL FIELD

The present invention relates to a heat shield to improve the insulation of a steam inlet duct admitting steam to a low-pressure turbine (referred to as "LP turbine"), notably in a power station.

BACKGROUND

Traditionally, in a power station installation, a low-pressure turbine is supplied by a duct with steam at a pressure of 3 to 6 bar and at a temperature of the order of 150° C. and the steam needs to be as dry as possible, and it emits this steam on the outlet side at a pressure of 40 to 150 millibar and a temperature of the order of 25° C. What is meant by "dry steam" is that the steam is in gaseous form and contains no (or practically no) droplets in liquid form. In theory, a flow of steam entering the LP turbine contains no moisture (or in other words needs to be dry, to contain no steam in the liquid state), whereas a flow of steam leaving the turbine contains between 8 and 16% moisture.

The design of such a turbine means that the steam inlet duct is partially comprised within the casing of the turbine and thus immersed within the turbine in the flow of exiting steam.

The result of this is that there are thermal interactions between the steam inlet duct and the flow of steam leaving the turbine, and these cause the steam arriving at the turbine to be cooled, thus increasing its moisture content.

Now, in order to have the best possible efficiency, it is necessary to have the driest possible steam in the supply duct, which preferably means steam with a moisture content of 0%.

It is therefore necessary to limit the thermal interactions between the steam inlet duct and the flow of steam leaving the turbine.

SUMMARY

The proposal is therefore an assembly comprising:

a duct, and at least one segment formed of at least two rigid shells, each shell comprising at least one fixing orifice for fixing to the duct and at least one fixing element, wherein: the duct comprises at least one boss per shell, which boss is fixed to the duct and against which boss the shell rests, at least one orifice and one boss face one another, and the fixing element passes through the orifice facing the boss and the fixing element is fixed to the boss.

The segment thus forms a heat shield minimizing any exchange (of heat) with an environment external to the duct, in this instance with the outgoing steam.

Advantageously, the segment has a shape similar to that of the duct. As a duct is generally of circular cross section, the segment is therefore also of circular cross section.

Further, an assembly according to the invention allows the possibility of adding a segment as defined hereinabove to an already-existing duct for example.

It is also possible to juxtapose several segments one after another so as to cover the entire duct.

Specifically, the duct, or at least the duct portion positioned in a zone in which it is necessary to minimize or even avoid heat exchangers, may be covered by a single segment or by several juxtaposed segments.

This means that the segments are easier to transport and/or to handle according to the dimensions of the duct that is to be covered or if the duct is of an irregular shape: for example if the duct has an elbow or is wider in places, etc.

A boss means a tubular cylindrical element which is advantageously internally threaded.

According to one advantageous embodiment, the bosses are fixed, for example, by welding, to the duct at right angles to the surface of the duct.

Next, the shells that make up a segment are fitted in such a way that a fixing element can be passed through an orifice in a shell and fastened into the boss. For example, the fixing element is a bolted connection (i.e. a screw and a nut), which means that the screw is fixed into the boss by a screw thread and holds the shell in place by simple bearing contact.

The shells of the segment also bear simply against the bosses around the duct.

The bosses thus maintain a space between the segment that forms the heat shield and the surface of the duct.

In addition, according to an advantageous embodiment, a first of the shells has a rim on one lateral edge to overlap a lateral edge of another of the shells, and preferably the first of the shells has two lateral edges, each with a rim.

In that way, the shells that make up a segment rest against one another. Such a connection both guarantees sealing between shells and maintains the possibility of movement.

The rim may form an integral part of the shell or may be a separate element welded to the lateral edge of the shell.

The shells are made for example of steel. If they are molded, it is preferable for the rim to form an integral part of the shell at the time of molding in order to simplify the production process. The shells may also advantageously be curved. The rim may then be formed by bending or even pressing.

If the rim is an added-on element, it has the advantage that clearance can be compensated for and contact with the rim of another shell adjusted in order to ensure sealing.

Thus, the shells, by resting against the bosses and against one another, experience a minimum level of stress when in use.

In addition, it is advantageous for the rim to belong to a shell situated further upstream in the flow of outgoing steam than the other shell or shells so as not to create a gap through which steam could infiltrate. Furthermore, the rims preferably are located along the entire length of the duct, forming a continuity.

According to yet another advantageous embodiment, at least one boss, and preferably each boss, is surmounted by a cap. The presence of a cap makes it possible to avoid a thermal bridge at the bosses that connect the heat shield to the duct. If a bolted connection is being used, then the cap covers the head of the screw.

For preference, the assembly comprises at least one partition between a first and a second boss, the partition being welded to at least the first boss and having a height smaller than that of the first boss.

Such a partition creates an obstacle to a flow of fluid between the heat shield and the duct if the heat shield does not seal properly, and therefore limits thermal interactions with the duct and the steam it contains.

It is then possible to position partitions between all the bosses or just between some of them according to whether the zones of the segment are at greater or lesser risk of leakage.

According to one embodiment whereby the heat shield is made up of at least two juxtaposed segments, it is preferable for the assembly to comprise an overlapping element, joined to at least one shell of a first segment of the assembly and overlapping one end of a shell of a second segment, in order to provide sealing between two consecutive segments. The overlapping element also advantageously rests on the shell of the second segment juxtaposed with the first. This also guarantees the shells freedom of movement in order to minimize stress in the heat shield while at the same time ensuring that the assembly is properly sealed.

A joint means that the overlapping element may form part of the shell to which it is attached, for example is a rim extending one end of the shell just as the rim extending a lateral edge to overlap an edge of another shell of the same segment. When the shells are produced by molding, for example, that enables the method of producing the assembly to be simplified. The lateral edge may also be created by bending or pressing, depending on the method chosen for creating the shells.

According to another method, the overlapping element may be a separate element and joint then means that it is attached, fixed, for example by welding, to the end of the shell. Thus contact or compensation for clearance can be adjusted when the assembly is being fitted together.

According to a preferred embodiment, the overlapping element is T-shaped. Such a shape makes it easier to attach to a shell of a first segment while at the same time ensuring that the overlapping element rests against a shell of a second segment. Further, the overlapping element also acts as a partition at the join between the two juxtaposed segments, in order also to contribute to limiting any flow in the event of a leak following defective sealing of the heat shield.

Advantagously, each segment and the duct between them define a space of constant height, and, for preference, each segment and the duct between them define a space filled with air.

For that, all the bosses preferably have the same height, for example thirty millimeters.

It is thus possible to benefit from the insulating properties of air while at the same time simplifying the implementation of the assembly.

Finally, a second aspect also proposes a turbine comprising an outer casing, an inner casing, and a steam inlet duct comprised between the outer casing and the inner casing so as to convey steam to the inner casing, wherein the turbine comprises an assembly as defined previously, and the duct of the assembly is the inlet duct admitting steam to the turbine.

Further advantages may also become apparent to a person skilled in the art for reading the examples hereinbelow, with reference to the attached figures which are given by way of entirely nonlimiting indication.

DETAILED DESCRIPTION

Figure 1:
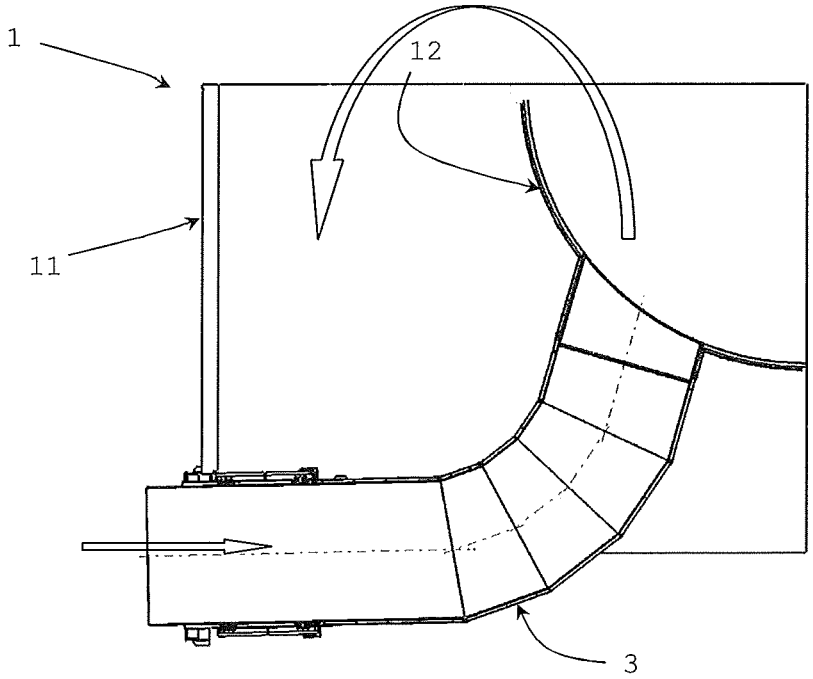
FIG. 1 depicts a cross section through a turbine according to the invention.

Identical elements depicted in FIGS. 1 to 7 are identified by the same numerical references.

A turbine 1 comprises an outer casing 11 and an inner casing 12 covering blades (not depicted).

It is supplied with steam by at least one steam inlet duct 2 comprised between the outer casing 11 and the inner casing 12. Steam flows in the direction of the arrows depicted in FIG. 1.

The steam entering the turbine 1 is typically at a temperature of 150° C. (degrees Celsius) and at a pressure of 3.5 bar; and the steam emitted at outlet, i.e. flowing out, in FIG. 1, between the outer 11 and inner 12 casings is at a pressure and temperature that are far lower (of the order of 46 millibar and 25° C.)

This is why there are problems with exchanges of heat between the steam inlet duct 2 situated between the outer 11 and inner 12 casings.

Figure 2:
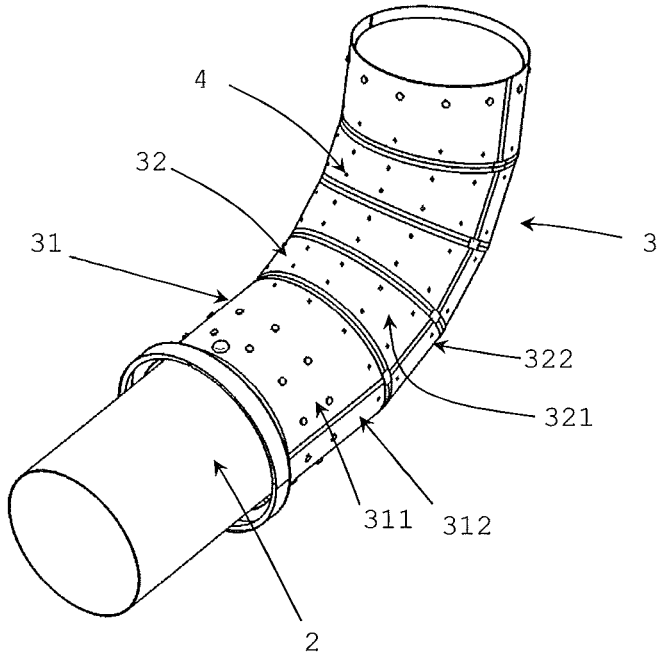
FIG. 2 depicts an assembly according to the invention.
Figure 3:
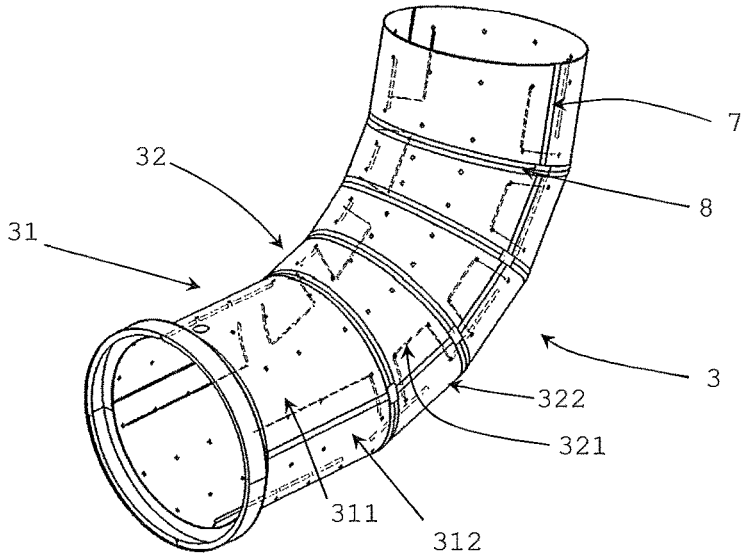
FIG. 3 depicts a heat shield according to the invention.
Figure 4A:
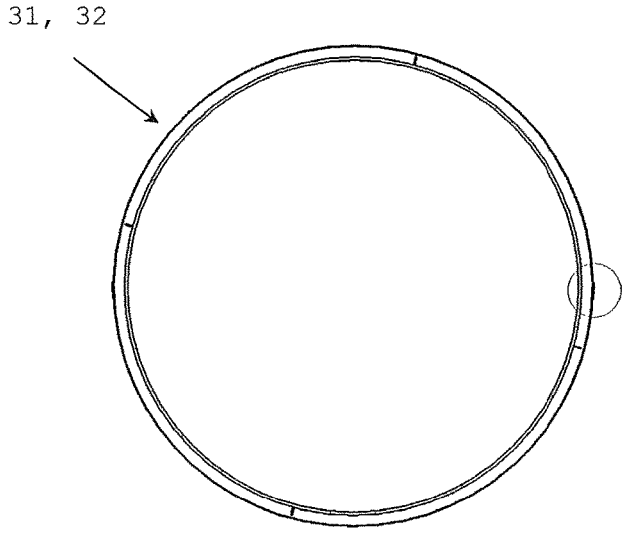
FIG. 4*a* shows a face-on view of a segment and FIG. 4*b* shows the junction between two shells of a segment.
Figure 4B:
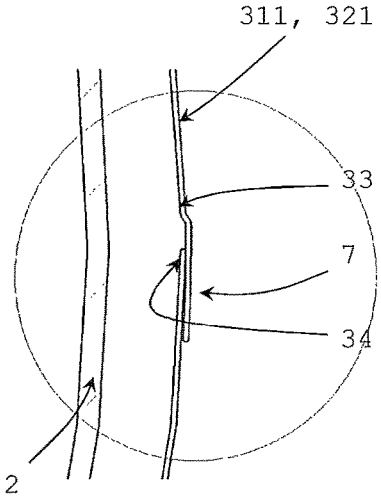
Figure 5:
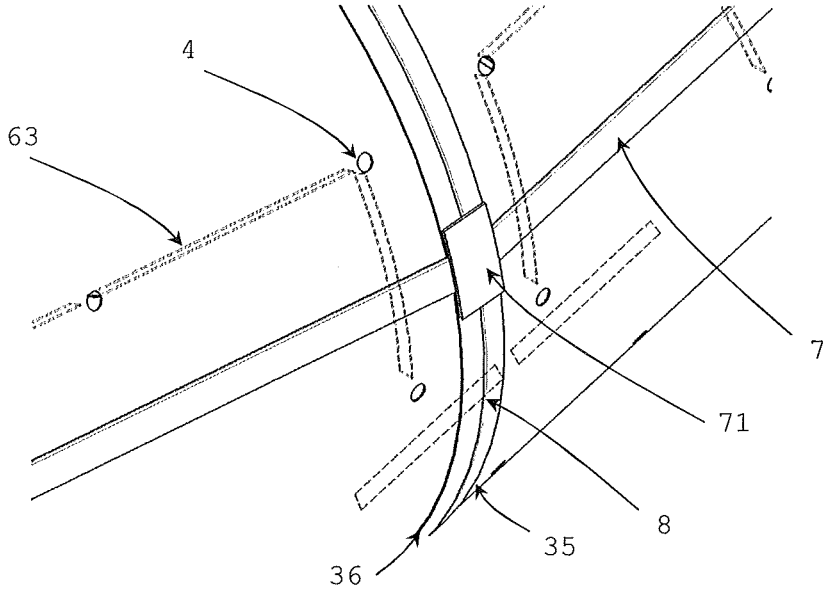
FIG. 5 is a perspective view of the junction between two shells of two consecutive segments.

In the example depicted in FIGS. 1 and 2, the duct 2 comprised between the outer 11 and inner 12 casings is completely covered by a heat shield 3 made up of several segments 31, 32.

In the present example, the duct 2 is of circular cross section, as is the heat shield 3.

Each segment 31, 32 is made up of two shells 311 and 312 or 321 and 322, which are rigid.

The shells 311, 312, 321, 322 are preferably curved and made of steel.

The shells 311, 312 have geometric dimensions that are similar so that the segment 31 overlaps a straight cylindrical part of the duct 2; whereas the shells 321, 322 have different geometric dimensions so that the segment 32 overlaps a curved part of the duct 2.

Figure 6:
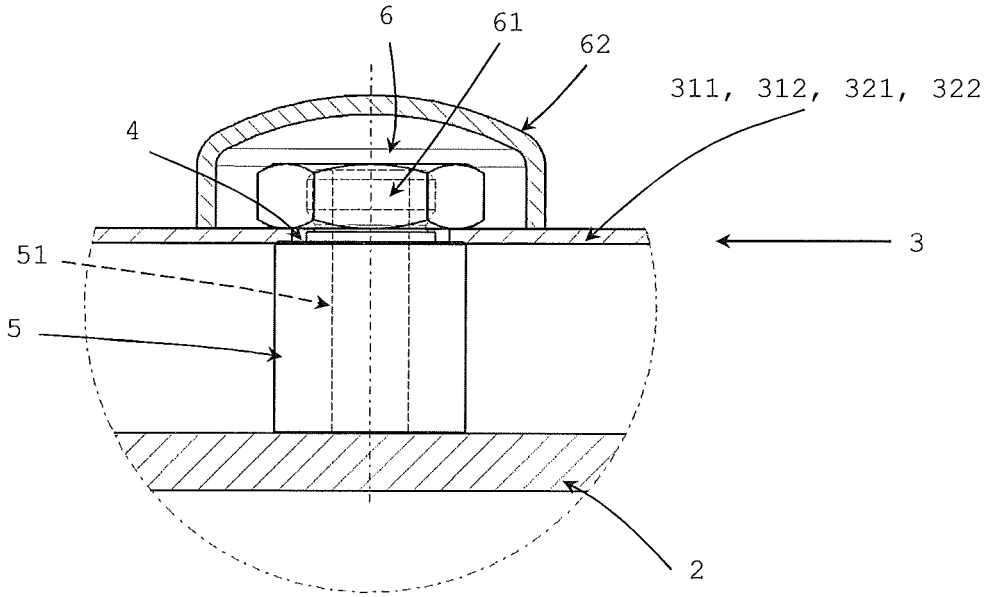
FIG. 6 is a cross section through a boss with a cap.
Figure 7:
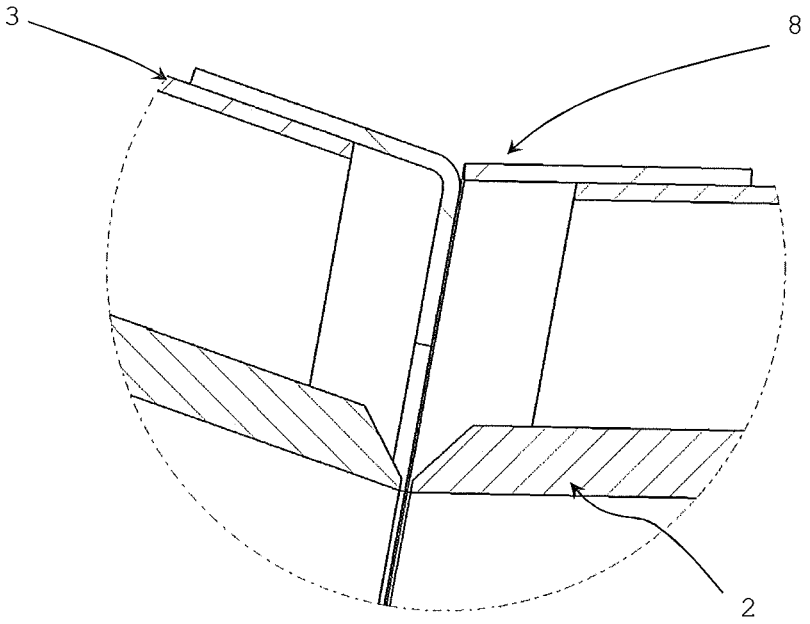
FIG. 7 is a cross section through a T-shaped overlapping element.

Each shell 311, 312, 321, 322 has at least one fixing orifice 4 (FIG. 6).

Each shell 311, 312, 321, 322 rests on at least one boss 5 welded to the duct 2.

A boss 5 is formed of a hollow cylindrical element comprising a threaded internal surface 51 (depicted in dotted line in FIG. 6).

A fixing element 6 is, for example, a screw 61.

The screw 61 passes through a fixing orifice 4 and screws into a boss 5.

Furthermore, the fixing element 6 is covered by a cap 62 so as to avoid there being any thermal bridges at the bosses 5.

The cap 62 is, for example, an independent component welded to the shell 311, 312, 321, 322 once the fixing element 6 has been fitted and so that the cap 62 is not in contact with the fixing element 6.

In the example depicted, all the bosses 5 are identical and notably all have the same height.

In that way, they define a space of constant height between the heat shield 3 and the duct 2 because the latter in this instance is cylindrical and regular (even though it has an elbow).

However, in other applications, if the duct has an irregular shape (such as a variable cross section for example), it may be beneficial for the bosses to have different heights in order to simplify the forming of the heat shield that is to cover it.

At least some bosses 5 have a partition 63 fixed, for example by welding, to a single boss 5 and extending in the direction of another boss.

The partition 63 is therefore situated between two bosses 5 and is attached to at least one of the two bosses between which it is located, and preferably to each of the two of them.

If there is defective sealing of the heat shield, the partitions 63 thus form a labyrinth creating an obstacle to any flow so as to limit exchanges of heat with the duct 2.

The partition 63 furthermore has a height lower than that of the bosses 5 between which it is located.

Finally, the shells 311, 312, 321, 322 have different connecting elements in order to provide sealing between two shells, 311, 312, 321, 322 of the same segment 31, 32 and between two consecutive segments 31, 32 if the heat shield 3 comprises several segments.

Between two shells 311 and 312, 321 and 322 of one and the same segment 31, 32, the connecting element is a rim 7, situated along a lateral edge 33 of a first shell 311, 321. The rim 7 is obtained by bending. It is therefore in contact with the edge 34 of the second shell 312, 322 of the same segment so that the connection between the shells is a fluidtight connection.

In the embodiment depicted in which each segment 31, 32 comprises two shells 311, 312, 321, 322, the first shells 311, 321 are considered to be the shells situated furthest upstream in the flow of outgoing steam, and these first shells 311, 321 therefore comprise a rim 7 along each of their two lateral edges 33.

Placing the rims 7 on the shells 311, 321 furthest upstream improves the sealing of the connection between the shells of one and the same segment by generating no gap open toward the arriving flow that might encourage an infiltration of steam.

Between two consecutive segments 31, 32, the connecting element is an overlapping element 8.

The overlapping element 8 in this instance is a component separate from the shells and attached, by welding, to one end 35 of a first shell (311, 312, 321, 322) of a first segment (31, 32) which segment is, preferably and if possible, the segment situated furthest upstream in the flow of outgoing steam, in order also to guarantee a better seal; further, it overlaps an end 36 of a shell (311, 312, 321, 322) of a second segment (31, 32) which is therefore further downstream in the flow.

Thus, whatever the connection element 7, 8 considered, it is preferably attached to the shell 311, 312, 321, 322 that is furthest upstream in the flow of outgoing steam and overlaps the shell 311, 312, 321, 322 further downstream in this flow. However, if the flow is orthogonal to the shells, i.e. if it is not possible to determine which shell would be furthest upstream, and the connecting element 7, 8 may be situated on one shell or the other with neither option preferred over the other.

Furthermore, the overlapping element 8 is T-shaped so that it also forms a partition, in the manner of the partitions 63 situated between two bosses 5.

Finally, a seal 71, for example in the form of a cover plate, is advantageously situated at the junctions between the connecting elements 7 and 8 so as to close off any gap that may have been left at this point.

What is claimed is:

1. An assembly comprising:

a steam inlet duct, and at least one segment formed of at least two rigid shells, the at least one segment disposed around a lateral surface of the steam inlet duct to cover the lateral surface of the steam inlet duct completely, and each shell of the at least two rigid shells comprising at least one fixing orifice for fixing to the steam inlet duct and at least one fixing element, wherein the steam inlet duct comprises at least one internally threaded boss per shell of the at least two rigid shells, where the at least one internally threaded boss is welded to the steam inlet duct and the at least two rigid shells rests in direct contact with the at least one internally threaded boss;

wherein the at least one fixing orifice and the at least one internally threaded boss face one another, wherein the at least one fixing element passes through the at least one fixing orifice facing the at least one internally threaded boss wherein the at least one fixing element is fixed to the at least one internally threaded boss;

wherein the at least one fixing element is covered by a cap welded to the shell of the at least two rigid shells; and further comprising at least one partition between a first internally threaded boss and a second internally thread boss of the at least one internally threaded boss, the at least one partition being welded to at least the first internally threaded boss and having a height smaller than that of the first internally threaded boss.

2. The assembly according to claim 1, wherein a first of the at least two rigid shells has a rim on one lateral edge to overlap a lateral edge of another of the at least two rigid shells.

3. The assembly according to claim 1, further comprising an overlapping element joined to at least one shell of the at least one segment of the assembly and overlapping one end of a shell of the at least two rigid shells of at least another segment of the assembly.

4. The assembly according to claim 1, wherein a space of constant height is defined between the at least one segment and the steam inlet duct.

5. The assembly according to claim 1, wherein a space filled with air is defined between the at least one segment and the steam inlet duct.

6. The assembly according to claim 3, wherein the overlapping element is T-shaped.

7. A turbine comprising:

an outer casing, an inner casing, and an assembly, the assembly comprising:

a steam inlet duct comprised between the outer casing and the inner casing and the steam inlet duct configured to convey steam to the inner casing, and at least one segment formed of at least two rigid shells, the at least one segment being disposed around a lateral surface of the steam inlet duct to cover the lateral surface of the steam inlet duct completely, and each shell of the at least two rigid shells comprising at least one fixing orifice for fixing to the steam inlet duct and at least one fixing element, wherein the steam inlet duct comprises at least one internally threaded boss per shell of the at least two rigid shells, where the at least one internally threaded boss is welded to the steam inlet duct and the at least two rigid shells rests in direct contact with the at least one internally threaded boss, wherein the at least one fixing orifice and the at least one internally threaded boss face one another, wherein the at least one fixing element passes through the at least one fixing orifice facing the at least one internally threaded boss wherein the at least one fixing element is fixed to the at least one internally threaded boss;

wherein the at least one fixing element is covered by a cap welded to a shell of the at least two rigid shells; and further comprising at least one partition between a first internally threaded boss and a second internally thread boss of the at least one internally threaded boss, the at least one partition being welded to at least the first internally threaded boss and having a height smaller than that of the first internally threaded boss.

8. The turbine according to claim 7, wherein a first of the at least two rigid shells has a rim on one lateral edge to overlap a lateral edge of another of the at least two rigid shells.

9. The turbine according to claim 7, wherein each of the at least one internally threaded boss is surmounted by a cap.

10. The turbine according to claim 7, further comprising an overlapping element joined to at least one shell of the at least one segment of the assembly and overlapping one end of a shell of the least two rigid shells of at least another segment of the assembly.

11. The turbine according to claim 7, wherein a space of constant height is defined between the at least one segment and the steam inlet duct.

12. The turbine according to claim 7, wherein a space filled with air is defined between the at least one segment and the steam inlet duct.

13. The turbine according to claim 10, wherein the overlapping element is T-shaped.

* * * * *